US008413478B2

(12) United States Patent
Tomaru et al.

(10) Patent No.: US 8,413,478 B2
(45) Date of Patent: Apr. 9, 2013

(54) METHOD OF DRAWING AND IRONING A RESIN FILM LAMINATED METAL SHEET AND RESIN FILM LAMINATED DRAWN AND IRONED CAN USING THE SAME METHOD

(75) Inventors: Hidekazu Tomaru, Yokohama (JP); Shinichi Taya, Kudamatsu (JP); Masahiro Kai, Kudamatsu (JP); Junichi Tanabe, Kudamatsu (JP); Etsuro Tsutsumi, Kudamatsu (JP); Norihito Saiki, Yokohama (JP)

(73) Assignees: Toyo Kohan Co., Ltd., Tokyo (JP); Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 12/092,683

(22) PCT Filed: Nov. 4, 2005

(86) PCT No.: PCT/JP2005/020660

§ 371 (c)(1),
(2), (4) Date: May 5, 2008

(87) PCT Pub. No.: WO2007/052364

PCT Pub. Date: May 10, 2007

(65) Prior Publication Data

US 2009/0113976 A1 May 7, 2009

(51) Int. Cl.
*B21D 22/20* (2006.01)
*B21D 22/00* (2006.01)

(52) U.S. Cl. ..... 72/349; 72/379.4

(58) Field of Classification Search ..... 72/347–349, 72/370.14, 379.4, 715, 370.23–370.25; 413/69, 413/76

See application file for complete search history.

(56) References Cited

U.S. PATENT DOCUMENTS

| | | | | | |
|---|---|---|---|---|---|
| 3,104,464 | A | * | 9/1963 | Frink | 72/370.14 |
| 4,346,580 | A | * | 8/1982 | Saunders | 72/349 |
| 4,782,685 | A | * | 11/1988 | Bulso et al. | 72/349 |
| 4,881,394 | A | * | 11/1989 | Jansen | 72/45 |
| 5,544,517 | A | * | 8/1996 | Shimizu | 72/349 |

FOREIGN PATENT DOCUMENTS

| | | | |
|---|---|---|---|
| JP | 11-57906 | A | 3/1999 |
| JP | 2003-277886 | A | 10/2003 |
| JP | 3582319 | B2 | 10/2004 |

* cited by examiner

*Primary Examiner* — Dana Ross
*Assistant Examiner* — Pradeep C Battula
(74) *Attorney, Agent, or Firm* — Sughrue Mion, PLLC

(57) ABSTRACT

A method of drawing and ironing a resin film laminated metal sheet for forming a can body having a bottom portion, a can wall portion and a flange-forming portion by drawing the resin film laminated metal sheet obtained by laminating at least one surface of a metal sheet with an organic resin film, followed by ironing by using a punch and a plurality of dies neighboring each other. The can wall is effectively prevented from being broken by a decrease in the thickness of the can wall, and drawn and ironed cans are efficiently formed having a thickness which is decreased as designed.

11 Claims, 9 Drawing Sheets

METHOD OF DRAWING AND IRONING A RESIN FILM LAMINATED METAL SHEET AND RESIN FILM LAMINATED DRAWN AND IRONED CAN USING THE SAME METHOD

CROSS REFERENCE TO RELATED APPLICATION

This application is a National Stage of International Application No. PCT/JP2005/020660 filed on Nov. 4, 2005.

TECHNICAL FIELD

The present invention relates to a method of drawing and ironing a resin film laminated metal sheet. More specifically, the invention relates to a drawing and ironing method capable of effectively preventing the can body from being broken and of decreasing the thickness of the can wall to a sufficient degree without developing a shock line on the can body during the ironing, and to a resin film laminated drawn and ironed can using the above method

BACKGROUND ART

The drawn and ironed cans are usually produced by punching a blank from a metal sheet, forming a cup by drawing the blank, mounting the drawn cup on a punch by using a drawing device which includes the punch and ironing dies of a plurality of stages, and inserting the cup together with the punch into the ironing dies so as to be finished having a predetermined can wall thickness and a can height. In the drawing and ironing, there are used large amounts of a lubricant and cooling water for lubrication and cooling during the working.

From the standpoint of preserving environment and further decreasing the weight of the can body in recent years, attempts have been made to further decrease the thickness of the can wall by ironing in the can body made of a resin-coated metal sheet that has hitherto been chiefly worked by drawing. As the thickness of the can wall is further decreased, however, the can wall tends to be easily broken making it difficult to decrease the thickness of the can wall, i.e., making it difficult to decrease the cost to a sufficient degree by reducing the weight.

In order to solve the above problem, Japanese Patent No. 3582319 teaches a method of producing seamless cans by inserting a blank holder in a drawn and formed body, advancing a punch into a cavity of a die while holding the bottom of the draw-formed body onto a flat surface of the die by using the blank holder, decreasing the thickness of the can wall relying upon the bend-elongation at the working corner while bringing the outer surface of the can wall of the draw-formed body into intimate contact with the working corner of the die of a small radius of curvature, and further decreasing the thickness of the can wall by the ironing based upon both the punch and the front end of the working corner in the ironing or the ironing portion ahead of the front end thereby to form a first seamless can longer than the drawn and formed body, followed by the working by using a punch provided with a tapered portion connecting to an upper end of a cylindrical portion of the punch, the tapered portion inclining rearward and inward at 0 degree, one minute to 0 degree, 30 minutes so as to be corresponded to a thickness profile of the drawn and formed body in the direction of height in which the thickness gradually increases toward the upper side of the can wall, so that the amount of reduction of thickness becomes equal in the direction of height after the ironing of the can wall of the drawn and formed body.

In the above method of producing seamless cans, the drawing and ironing is effected by using a re-drawing die and an ironing die in combination. Particularly, the opening of the formed can has not been subjected to the ironing but is simply subjected to half way of the drawing. Therefore, the thickness cannot be decreased highly precisely up to the opening.

As the ironing method, further, JP-A-2003-19518 discloses an ironing method for decreasing the thickness of the cup wall by bringing a metal cup supported by a punch into mesh with a die for ironing, wherein the ironing portions of the preceding stage and the succeeding stage are arranged in succession maintaining a distance of 3 to 20 mm between the lands, and the ironing portion of the preceding stage effects the ironing of an amount of not smaller than 20% of the whole amount of ironing effected by the ironing portion of the preceding stage and by the ironing portion of the succeeding stage.

However, an attempt to form a drawn and ironed can having a further decreased thickness by the above ironing method is accompanied by a problem of breakage in the can wall.

The present inventors have conducted a keen study to investigate the cause of breakage of the can wall and have discovered the following facts. That is, when the ironing is effected by using the ironing dies of the preceding stage and the succeeding stage arranged in succession as in the above ironing method, a shock line (locally thinned portion) occurs at a position corresponding to an end on the side of the can wall at a stepped portion formed between the flange-forming portion and the can wall due to the arrival of the die of the preceding stage, and the can wall is broken. Besides, the thickness of the can wall near the stepped portion becomes greater than a clearance established between the punch and die, making it difficult to obtain a thickness profile as designed.

DISCLOSURE OF THE INVENTION

It is therefore an object of the present invention to provide a method of drawing and ironing a resin film laminated metal sheet for forming a can body having a bottom portion, a can wall portion and a flange-forming portion by drawing the resin film laminated metal sheet obtained by laminating at least one surface of a metal sheet with an organic resin film, followed by ironing by using a punch and a plurality of neighboring dies, wherein occurrence of a shock line is prevented by the use of a plurality of dies, the can wall is not broken even when the thickness thereof is further decreased, the thickness is prevented from becoming greater than a clearance established near the stepped portion, and the thickness profile of the can wall is uniformed near the flange-forming portion.

According to the present invention, there is provided a method of drawing and ironing a resin film laminated metal sheet for forming a can body having a bottom portion, a can wall portion and a flange-forming portion by drawing the resin film laminated metal sheet obtained by laminating at least one surface of a metal sheet with an organic resin film, followed by ironing by using a punch and a plurality of neighboring dies, wherein the punch has a taper formed at a position corresponding to the can wall portion continuous to the flange-forming portion, the taper having a length greater than a distance between the land of a first die of the plurality of dies and the land of a die in the final stage.

In the drawing and ironing method of the present invention, it is desired that:

1. The punch has a small-diameter portion at a rear end portion thereof, and effects the ironing in a manner that the ratio of ironing is 0 to 15% at the open end of the can body that is formed; and 2. The two dies include the die of the preceding stage and the die of the succeeding stage arranged in succession.

According to the present invention, there is further provided a drawn and ironed can having a bottom portion, a can wall portion and a flange-forming portion formed by drawing and ironing a resin film laminated metal sheet obtained by laminating at least one surface of a metal sheet with an organic resin film, wherein the inner surface of the can wall portion continuous to the flange-forming portion is tapered in a manner that the thickness decreases from the upper side toward the lower side starting from the lower portion of the flange-forming portion, and no step is formed on the outer surface of the can wall portion.

In the method of ironing the drawn and ironed can of the invention, the punch in the ironing has an outer surface that is tapered at a position corresponding to the can wall portion continuous to the flange-forming portion, the taper having a length greater than a distance between the land of a first die in the plurality of dies and the land of a die in the final stage.

FIGS. 1 and 2 are views illustrating, on an enlarged scale, a portion X in FIG. 9 in a step of a drawing and ironing method that will be described later. In a conventional drawing and ironing method as shown in FIG. 1, a punch 10 forms, at a rear end portion thereof, a small-diameter portion 11 corresponding to the flange-forming portion, a large-diameter portion 12 corresponding to the can wall portion, and a taper portion 13 that connects the small-diameter portion 11 to the large-diameter portion 12 in order to form, on the can, a thick flange-forming portion 3 that forms a flange and a stepped portion 5 that forms a taper on the inner surface thereof at a position between the flange-forming portion 3 and a thin can wall portion 4.

In the drawing and ironing method of the present invention as shown in FIG. 2, on the other hand, a tapered portion 14 is formed on the rear end portion of the conventional punch shown in FIG. 1, the tapered portion 14 having a length $L_2$ greater than a distance $L_1$ between a land portion 21A of a die 20A of a preceding stage and a land portion 21B of a die 20B of a succeeding stage. On the rear end portion of the punch 10, there are formed a small-diameter portion 11, a tapered portion 13 and a tapered portion 14 of a length greater than the distance between the lands, which is continuous to a large-diameter portion 12.

Therefore, the thickness of the can 2 limited by the punch is greater than that of the prior art at the boundary portion 6 between the stepped portion 5 and the can wall portion 4 and, besides, there is no sharp change in the boundary portion 6. Therefore, the state of forming mildly changes from the can wall portion 4 to the flange-forming portion 3. Even when the die 20A of the preceding stage arrives at the boundary portion 6, therefore, there occurs no shock line unlike that of when the conventional punch is used, and the can wall is effectively prevented from being broken despite the thickness is decreased. Besides, the thickness can be realized nearly as determined by the clearance that is established, and a uniform thickness profile can be obtained.

The above action and effect of the invention will become obvious from FIGS. 3 to 6, too, showing the results of Examples that will be described later.

That is, FIG. 3 is a graph in which the designed thicknesses of the can walls formed by using the conventional punch shown in FIG. 1 and by using the punch of the invention shown in FIG. 2 are corresponded to the height from the bottoms of the cans. When the punch of the invention is used as will be obvious from this graph, a long and mild taper is formed on the can wall portion as compared to when the conventional punch is used, and the taper at the stepped portion that is usually formed is shorter than that of the prior art.

FIG. 4 is a graph illustrating the thickness profiles of the can walls corresponding to the height from the bottoms of the cans really formed by using the above punches. It will be obvious that when the conventional punch is used, a shock line is formed at an upper part of the can wall continuous to the stepped portion (portion S in FIG. 4).

FIGS. 5 and 6 are graphs in which the designed thicknesses of the can walls formed by using the conventional punch and by using the punch of the invention and the thickness profiles of the can walls really formed are corresponded to the height from the bottoms of the cans. When the conventional punch is used as is obvious from FIG. 5, there occurs a large difference between the designed thickness and the real thickness at an upper part of the can wall continuous to the stepped portion losing stability in the state of forming. When the punch of the present invention is used as is obvious from FIG. 6, on the other hand, there occurs almost no difference between the designed thickness and the real thickness at the above portion, and the state of forming is stable.

BEST MODE FOR CARRYING OUT THE INVENTION

Drawing and Ironing Method

Figure 1:
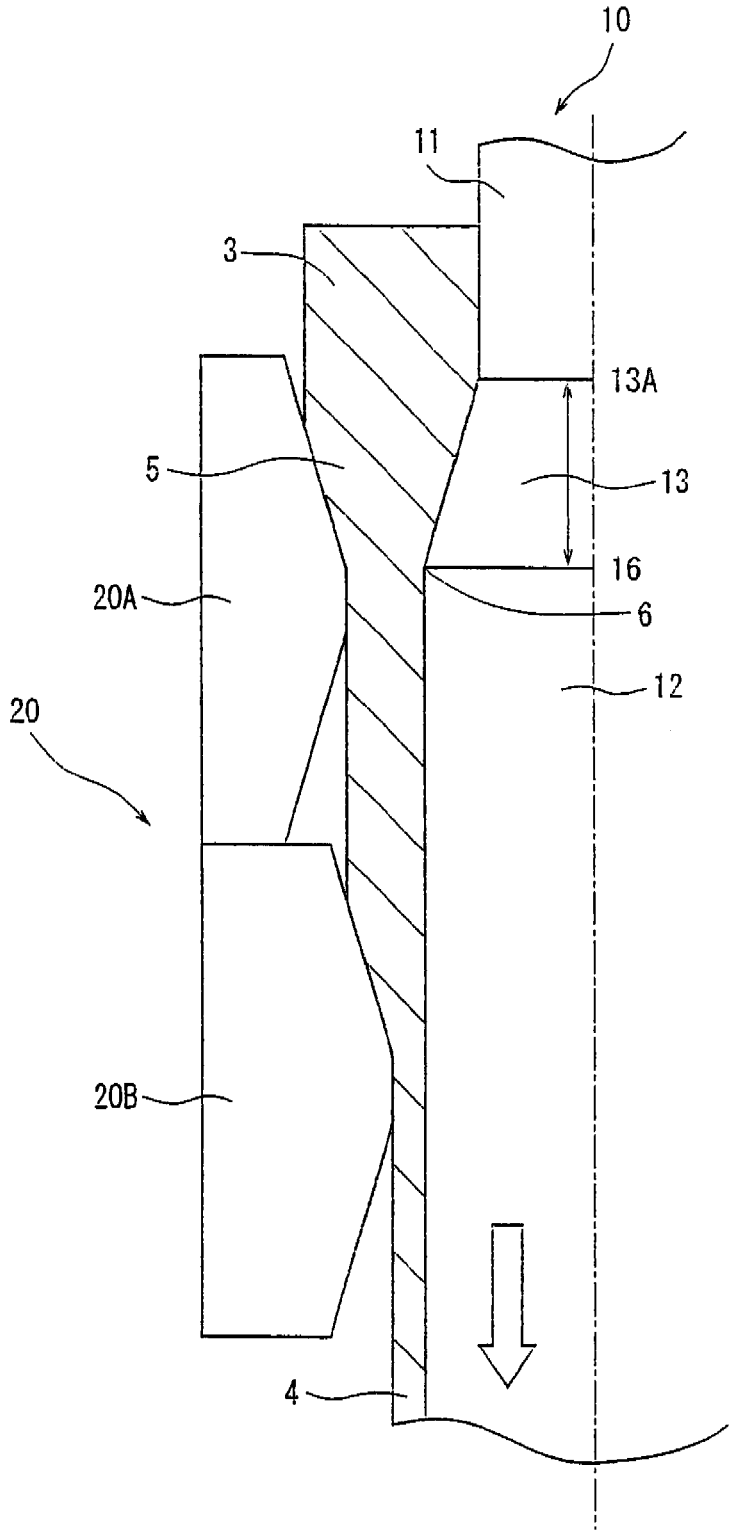
FIG. 1 is a view illustrating, on an enlarged scale, a portion X in FIG. 9 in a conventional drawing and ironing method.

In the drawing and ironing method of the present invention, an important feature resides in the use of a punch forming a taper of a length greater than a distance between a land of a first die in a plurality of dies and a land of a die of the final stage at a position corresponding to the can wall portion continuous to the flange-forming portion. In other respects, the drawing and ironing method of the invention can be carried out in compliance with the conventional drawing and ironing method.

Figure 7:
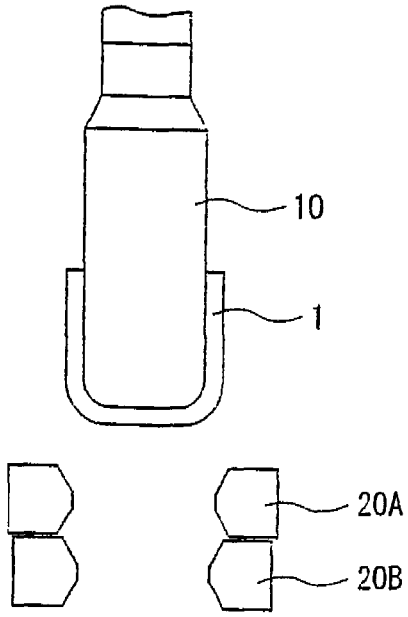
FIG. 7 is a view schematically illustrating a portion of the steps in the drawing and ironing method.
Figure 8:
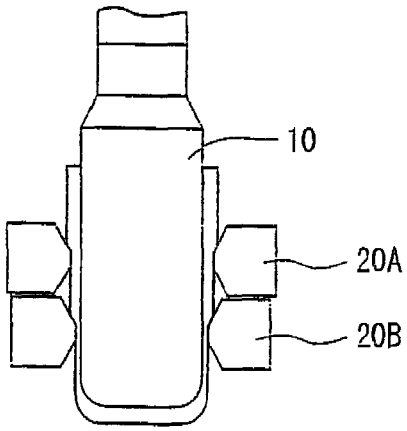
FIG. 8 is a view schematically illustrating a portion of the steps in the drawing and ironing method.
Figure 9:
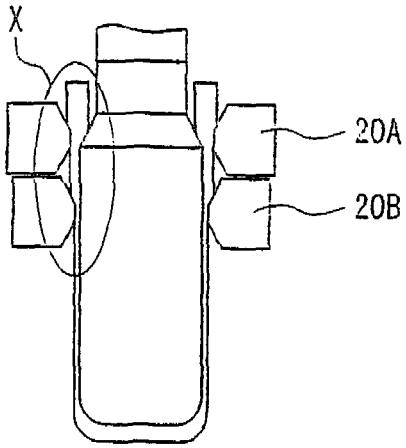
FIG. 9 is a view schematically illustrating a portion of the steps in the drawing and ironing method.
Figure 10:
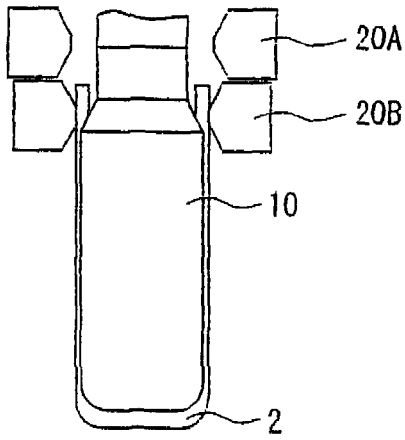
FIG. 10 is a view schematically illustrating a portion of the steps in the drawing and ironing method.

FIGS. 7 to 10 are views of steps schematically illustrating the drawing and ironing method of when there are used ironing dies of two stages. In the drawing and ironing method of the present invention, first, a blank is punched from a resin film laminated metal sheet by a conventional method and is drawn to form a drawn cup 1. Thereafter, as shown in FIG. 7, the drawn cup 1 is fitted to a punch 10. Referring to FIGS. 8 to 10, the cup 1 together with the punch 10 are inserted in an ironing die 20 comprising two dies, i.e., a die 20A of a preceding stage and a die 20B of a succeeding stage arranged in succession so as to be ironed, whereby the thickness of the can wall of the drawn cup 1 is decreased and the height of the can is increased to form a desired can 2 having a bottom portion, a can wall portion and a flange-forming portion.

Figure 2:
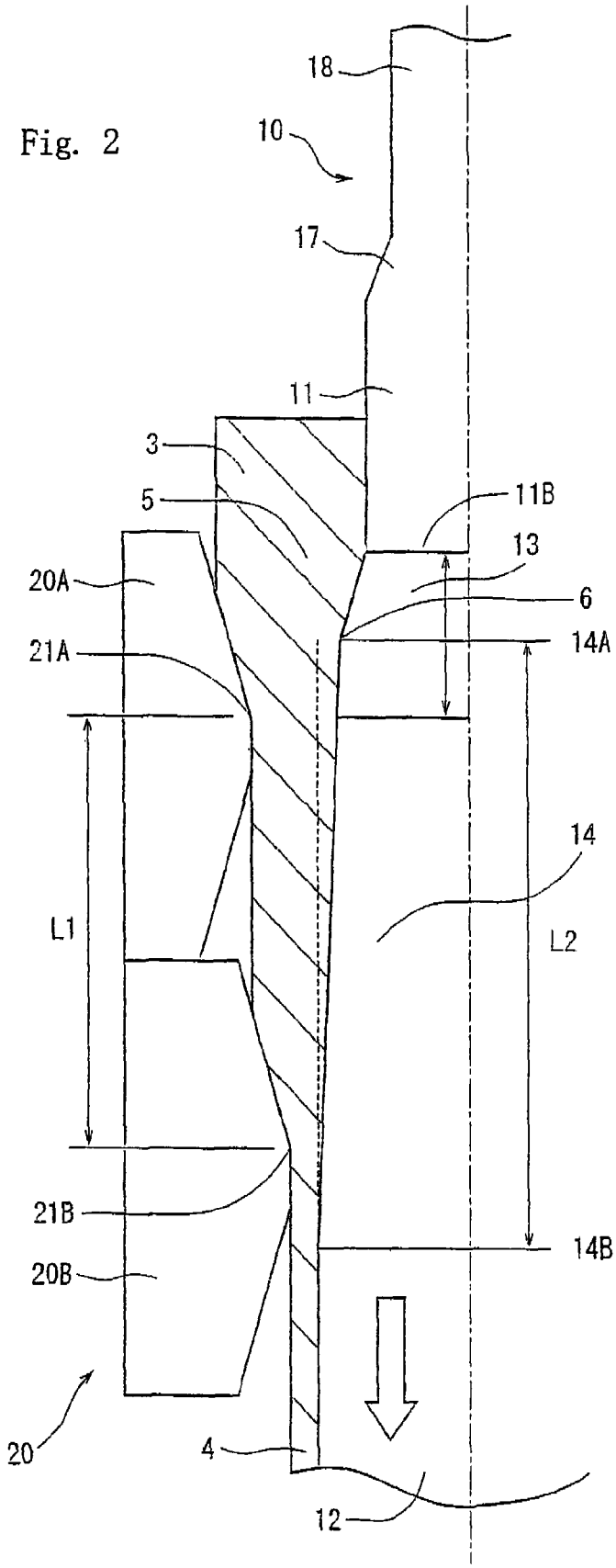
FIG. 2 is a view illustrating, on an enlarged scale, a portion X in FIG. 9 in a drawing and ironing method of the present invention.

In the present invention, it is desired that the taper is formed on the punch at the position corresponding to the can wall portion continuous to the flange-forming portion, and has a length greater than a distance between the land of the die of the final stage and the land of the first die in a plurality of dies, the upper end 14A of the taper being formed between the lower end 11B of the small-diameter portion 11 corresponding to the flange-forming portion and the boundary portion 16 of the tapered portion 13 corresponding to the stepped portion 5 and the large-diameter portion 12. As shown in, for example, FIG. 2 above, the upper end 14A may be positioned at the tapered portion 13 higher than the boundary portion 16 in FIG. 1 to form two stages of taper portions 13 and 14 or, the upper end 14A may be positioned at the lower end 11B of the small-diameter portion 11 corresponding to the flange-forming portion thereby to form a single stage of mild taper from the lower end 11B of the small-diameter portion 11.

The outer shape of the punch is not limited to the one described above but may be a combination of a plurality of tapers or may be a curved surface so far as the taper is mildly formed on the can wall portion continuous to the flange-forming portion maintaining a length greater than the distance between the lands.

The length of the taper may be greater than the distance between the land of the first die and the land of the die of the final stage. There is no limitation on the angle from the standpoint of achieving the object of the present invention. However, if the taper is too long or the angle is too great, the thickness of the can wall becomes unnecessarily great, which is not desired from the standpoint of productivity and the cost of the materials. Therefore, the length of the taper and the angle thereof may be suitably selected for each of the cases depending upon the height of the can and the diameter of the can wall portion.

For example, in the case of a drawn and ironed can having a height H of 120 mm and a height of 60 mm from the bottom of the can as will be described later in Examples, it is desired that the length $L_2$ of the taper is $L_2$=[distance $L_1$ between the lands+(1 to 30 mm)] and that the angle θ is in a range of $0<\theta\leqq 0°30'$.

In the punch used in the present invention, further, it is desired that the punch has a small-diameter portion 18 formed over the small-diameter portion 11 corresponding to the rear end portion thereof, i.e., corresponding to the flange-forming portion, via a tapered portion 17 of which the diameter is decreasing from the lower side toward the higher side. It is desired that the small-diameter portion 18 is the one that so works that the ratio of ironing at the opening of the can body is 0 to 10% from the standpoint of preventing the occurrence of resin hairs (filament-like cutting scraps formed as the resin coating on the open end is extruded and cut). The ratio of ironing is found by regarding the thickness measured at a portion 1 mm lower than the lowest can height of the ironed can to be the thickness after the working and by comparing this thickness with the thickness of the can wall of before the ironing.

That is, when the open end of the can passes through the ironing die 20, the laminated resin film at the open end of the can body is not subjected to the ironing in excess of a damaging limit, since the gap between the small-diameter portion 18 of the punch 10 and the inner diameter of the ironing die 20A has been set to be greater than the damaging limit for the laminated resin film. Therefore, the drawn cup 1 that is ironed being fitted to the punch 10 has a thick flange-forming portion 3 formed near the opening of the can body, and there occurs no resin hair at the open end of the can body.

The small-diameter portion 18 of the punch 10 may be formed as a straight step portion or may be so formed that the diameter thereof gradually decreases like a taper forming such a diameter that does not effect the ironing on the way of the tapered portion. This method gives an advantage in that the pressure of the ironing is gradually released. It is desired that the above taper shape starts with a portion at least 3 mm higher than a portion (trim position) that becomes the final height of the can. It is desired that the taper angle is 0.1 to 30° and, more preferably, 0.5 to 5°. When the taper angle is smaller than 0.1°, no effect is exhibited against the occurrence of resin hair. When the taper angle exceeds 30°, a problem arouses with respect to the strength of the punch or vibration of the punch during the ironing.

In the present invention, it is desired to conduct the ironing working by using a plurality of dies or, at least, two dies and by setting the distance between the lands of the two dies to be 3 to 40 mm. It is desired that the two dies are arranged in succession. Arranged in succession means that the ironing portion of the preceding stage and the ironing portion of the succeeding stage are arranged in succession being simultaneously inserted in the portion where the ironing is to be effected by the punch. Desirably, the ironing portion of the preceding stage and the ironing portion of the succeeding stage are constituted separately from each other. Moreover, there may be included two ironing portions integrally together, or two dies may be arranged interposing a spacer therebetween. As compared to the above-mentioned case, the method of effecting the ironing by setting the distance between the lands of the two dies to be 3 to 40 mm is desirable from the standpoint of removing the can after the ironing. Further, by using at least two dies as described above, a limit ratio of ironing is improved to about 64% per a stage of ironing, and there is obtained a can having an increased can height without forming resin hairs.

Figure 11:
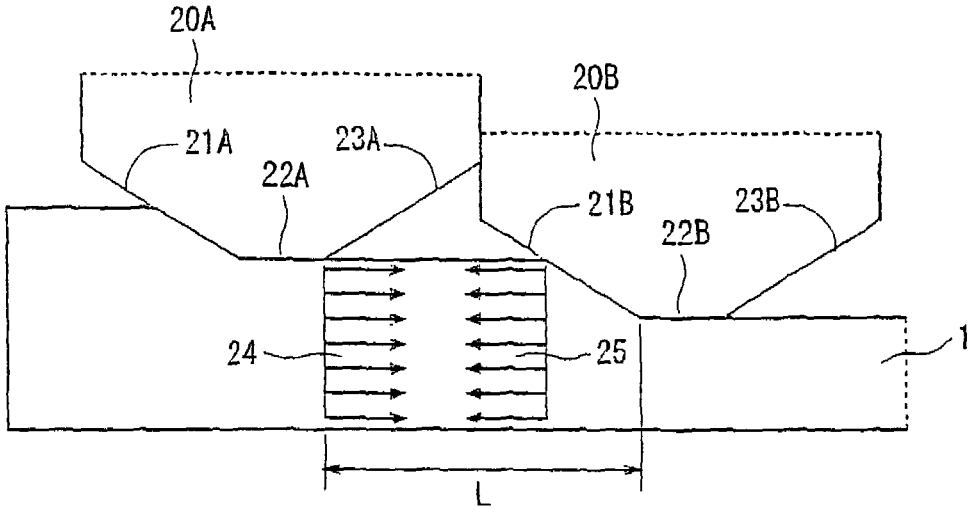
FIG. 11 is a view illustrating dies for ironing used in the drawing and ironing method of the present invention.

Referring to FIG. 11 illustrating ironing dies arranged in succession used in the present invention, the ironing portion includes an ironing portion 20A of the preceding stage and the ironing portion 20B of the succeeding stage, the working portions of the preceding stage and the succeeding stage having die approach portions 21A, 21B, land portions 22A, 22B, and exit surfaces 23A, 23B. The ironing portions have the same functions as the ironing portions in the conventional ironing dies. According to the present invention, however, the ironing of the preceding stage and the ironing of the succeeding stage are effected simultaneously, whereby the forming stress 24 in the axial direction generated by the ironing portion of the preceding stage is effectively utilized as back tension 25 during the ironing of the succeeding stage, improving the limit ratio of ironing per a stage of ironing, greatly decreasing the deformation of the ironing die in the radial direction in the succeeding stage and realizing a homogeneous and uniform ironing.

An increased effect is obtained when the distance L between the land of the preceding stage and the land of the succeeding stage is short and it is desired that the distance L between the lands is not greater than 40 mm from the standpoint of effectively utilizing the back tension obtained by the ironing portion 20A of the preceding stage, improving the limit ratio of ironing in the ironing and suppressing the deformation of the ironing die in the radial direction in the succeeding stage. Even when 40 mm is exceeded, the effect of back tension is obtained. At the time of trimming, however, the material must be removed by an increased amount, which is not desirable economically. From the standpoint of saving resources, as described above, it is desired that the distance L between the lands is short for effectively decreasing the volume of the thick portion at the open end of the can body, and is in a range of 3 to 40 mm and, particularly, in a range of 3 to 20 mm.

In the present invention, further, it is desired that the amount of ironing by the ironing portion of the preceding stage is not smaller than 20% of the whole amount of ironing effected by the ironing portion of the preceding stage and by the ironing portion of the succeeding stage. The ironing portion of the preceding stage and the ironing portion of the succeeding stage are arranged in succession, and the ironing is effected by the ironing portion of the preceding stage to a degree greater than a particular ratio, so that the ironing can be effected by the ironing portion of the succeeding stage in a state where the back tension is working to a suitable degree. In the working portion of the succeeding stage, therefore, the stress decreases in the radial direction of the ironing die. A decrease in the stress makes it possible to suppress deformation in the radial direction of the ironing die, which is a defect that arouses when the die approach angle is decreased.

When the amount of ironing by the ironing portion of the preceding stage is not larger than 20% of the whole amount of ironing by the ironing portion of the preceding stage and by the ironing portion of the succeeding stage, the forming stress by the ironing portion of the preceding stage is small and, hence, a small back tension acts on the ironing portion of the succeeding stage, making it difficult to improve the effect of ironing by the ironing portion of the succeeding stage or to suppress the deformation in the radial direction of the ironing die of the succeeding stage to a sufficient degree.

The method of drawing an organic resin film laminated metal sheet of the present invention can be applied to either a conventional ironing working that uses a lubricating oil or the cooling water or to a dry ironing working that uses a volatile lubricating oil of a high temperature.

The draw-ironing can be effected through a plurality of stages of ironing steps, such as effecting the ironing in a range without exceeding a damaging limit of the organic resin film laminating at a step preceding the ironing portions of the preceding stage and of the succeeding stage arranged in succession, and effecting the ironing to a degree of not greater than 10% for improving the removal of the can from the punch at a step succeeding the ironing portions of the preceding stage and of the succeeding stage arranged in succession.

(Organic Resin-Coated Metal Sheet)

The above-mentioned ironing method of the present invention is particularly effective in drawing and ironing a variety of plated steel plates or surface-treated steel plates such as an electrolytic chromium acid treated steel having a two layer structure of a lower layer of metal chromium and an upper layer of chromium oxide hydrate, and a tin plate, metal sheets obtained by laminating both surfaces of a metal sheet such as a stainless steel sheet, an aluminum sheet or an aluminum alloy sheet with an organic resin film which is a thermoplastic resin such as polyester resin, polyolefin resin or polyamide resin, a laminated metal sheet laminated with a laminating material of a thermoplastic resin or a thermosetting resin, or metal sheet coated with an organic resin containing a pigment, a filler and the like in the organic resin film.

It is desired that the organic resin film has a thickness of 5 to 100 μm. The resin film that can be used in the present invention is either a single-layer film or a plurality of films of two or more layers, and desirably comprises a thermoplastic resin and, particularly, a polyester resin.

As the polyester resin, it is desired to use those having an ester unit, such as ethylene terephthalate, ethylene isophthalate, butylene terephthalate and butylene isophthalate and, particularly, a polyester comprising chiefly at least one kind of an ester unit selected out of them. Here, the ester units may be copolymerized. Or, as required, there may be employed those using homopolymers or copolymers of two or more kinds of ester units being blended together. In addition to the above, there can be further used naphthalenedicarboxylic acid, adipic acid, sebacic acid and trimellitic acid as acid components of an ester unit, as well as those using propylene glycol, diethylene glycol, neopentyl glycol, cyclohexanedimethanol and pentaerythritol as alcohol components of the ester unit.

The polyester may be a homopolyester or a copolyester, or a laminate of two or more polyester layers of a blend of two or more kinds thereof. For example, the lower layer of the polyester film may be a copolymerized polyester resin having excellent heat adhesiveness and the upper layer may be a polyester layer or a reformed polyester layer having excellent strength, heat resistance and barrier property against corrosive components.

In the present invention, it is desired to use a monoaxially stretched film, a biaxially stretched film or an non-stretched film. It is, however, desired to use a film of an non-stretched polyester resin. The inherent viscosity and the strength of the resin must be enhanced so that the resin is not cut when the polyester resin film is being laminated on the surface-treated steel plate, and that the resin is not ground, scratched, cracked or peeled even when the surface-treated steel plate on which the polyester resin film is laminated is subjected to a severe forming such as drawing or drawing and ironing.

For this purpose, it is desired that the inherent viscosity of the polyester resin lies in a range of 0.6 to 1.4 and, more preferably, 0.8 to 1.2. When the inherent viscosity is smaller than 0.6, the strength of the resin using the polyester resin becomes very small and the resin cannot be used for the cans that are to be formed through the drawing or through the draw-ironing. When the inherent viscosity of the resin exceeds 1.4, on the other hand, the melt viscosity becomes very high when the resin is heated and melted making it very difficult to laminate the polyester resin film on the surface-treated steel plate.

It is desired that the thickness of the resin film is 5 to 100 μm in the case of a single-layer film and, preferably, 10 to 40 μm. When the thickness is smaller than 5 μm, it becomes difficult to laminate the resin film on the surface-treated steel plate, developing defects in the resin layer after the drawing or the drawing and ironing. When a can is formed and is filled with a content, further, the resin film fails to exhibit a sufficiently large resistance against the permeation of corrosive components. When the thickness is increased, the resistance against the permeation becomes sufficient. However, a thickness in excess of 100 μm becomes economically disadvantageous. In the case of a plurality of films, the ratio of thicknesses thereof may be varied from the standpoint of forming, resistance against permeation and effect upon the flavor of the content. The thicknesses of the films, however, are so adjusted that the total thickness thereof is 5 to 60 μm.

In preparing the resin film, further, there may be contained a pigment, a stabilizer, an antioxidant, a lubricant and the like in the resin in amounts in which they do not impair the required properties. There may be further used a metal sheet laminated with a polyester resin film without containing pigment on the surface that becomes the inner surface of the can and laminated with a polyester resin film containing a pigment such as titanium oxide on the surface that becomes the outer surface of the can.

The organic resin film may be directly laminated on the heated surface-treated steel plate or may be laminated thereon via an adhesive. There may be further used an extrusion lamination method for laminating the molten resin directly on the surface-treated steel plate. The above lamination methods are the known ones.

(Drawn and Ironed Can)

The above-mentioned organic resin-coated metal sheet is subjected to the drawing and ironing of the invention to obtain a drawn and ironed can of which the thickness is decreased as designed and having a uniform thickness profile effectively preventing the occurrence of shock lines.

The drawn and ironed can has a thickness profile corresponding to the punch mentioned above, and an important feature resides in the formation of a taper having a length greater than a distance between the land of the first die and the land of the final die of the plurality of dies on the can wall portion continuous to the flange-forming portion.

In the drawing and ironing method of the present invention, the ironing die of the succeeding stage executes the ironing perfectly up to the upper end of the can body. According to the method of the invention, therefore, no step is formed on the outer surface of the can wall portion of the drawn and ironed can.

The drawn and ironed can obtained by the method of the present invention can be subjected to the known trimming, necking and flanging.

EXAMPLES

The invention will be described in further detail by way of Examples.

Examples 1 to 3

Comparative Examples 1 and 2

As a sample plate, there was used an organic resin film laminated steel plate obtained by laminating the surface of an electrolytic chromium acid treated steel sheet of a thickness of 0.190 mm with a transparent polyester film of a thickness of 28 μm on the side that becomes the inner surface of the can body and with a white polyester film of a thickness of 16 μm to which a titanium oxide pigment has been added on the side that becomes the outer surface of the can body. Circular blanks of a diameter of 151 mm were punched from the organic resin film laminated steel plate and were subjected to the drawing of a first stage to form drawn cups of a diameter of 91 mm, which were, then, subjected to the drawing of a second stage to form drawn cups of a diameter of 66 mm.

By using an ironing apparatus comprising two stages of ironing portions including ironing dies having distances $L_1$ between the lands shown in Table 1 and including punches of tapered shapes (taper lengths $L_2$, taper angles θ) shown in Table 1, the cups were subjected to the ironing under the conditions described below to form draw-ironed cans.

Drawing of the first stage: ϕ91 mm (cup)

Drawing of the second stage: ϕ66 mm (cup)

Clearance $CL_1$ between the ironing die and the punch in the preceding stage: 0.120 mm (fixed)

Clearance $CL_2$ between the ironing die and the punch in the succeeding stage: described in Table 1

The thickness of the can wall was measured at a position of a height of 60 mm from the bottom of the can.

Press forming speed: 200 (strokes per minute)

In all punches, the taper was formed starting from a position 130 mm away from the end of the punch (bottom of the can), and the diameter was decreased down to 63 mm.

[Formability of the Can Body]

The clearance between the die and the punch of the succeeding stage was varied as shown in Table 1 to make sure if the can could be formed and, at the same time, the thickness (Tw) of the wall of the formed can was measured. The thickness (Tw) of the can wall was measured at a height of 60 mm from the bottom of the can. Evaluation was on the following basis. The results were as shown in Table 1.

○: The can body could be formed without interruption.

X: The can wall portion was broken during the ironing (breakage of can wall).

[Thickness Profile of the Can Body]

Figure 3:
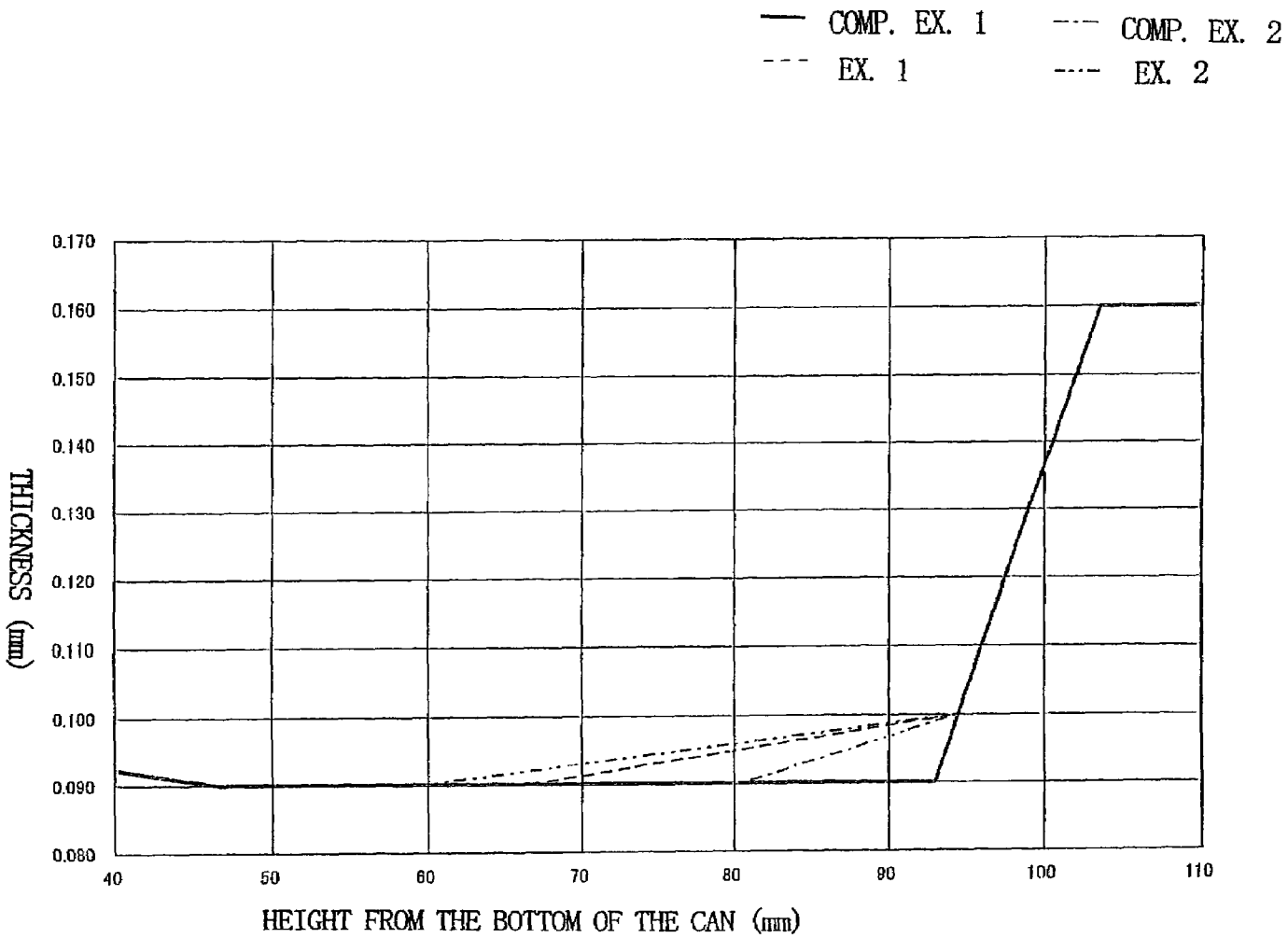
FIG. 3 is a graph in which the designed thickness of the can wall formed by using a conventional punch shown in FIG. 1 is corresponded to the height from the bottom of the can.
Figure 4:
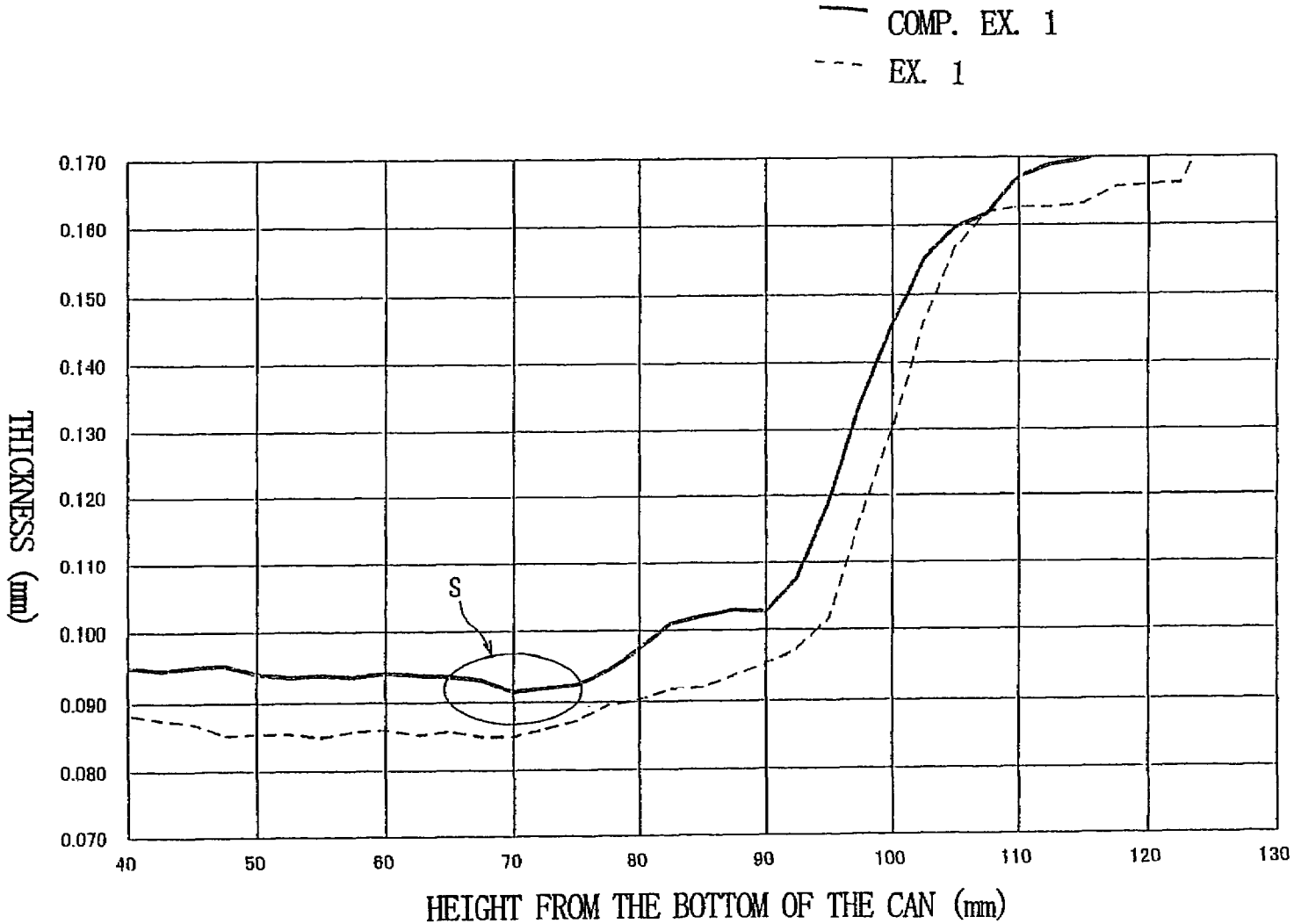
FIG. 4 is a graph in which the designed thickness of the can wall formed by using the punch of the present invention shown in FIG. 2 is corresponded to the height from the bottom of the can.
Figure 5:
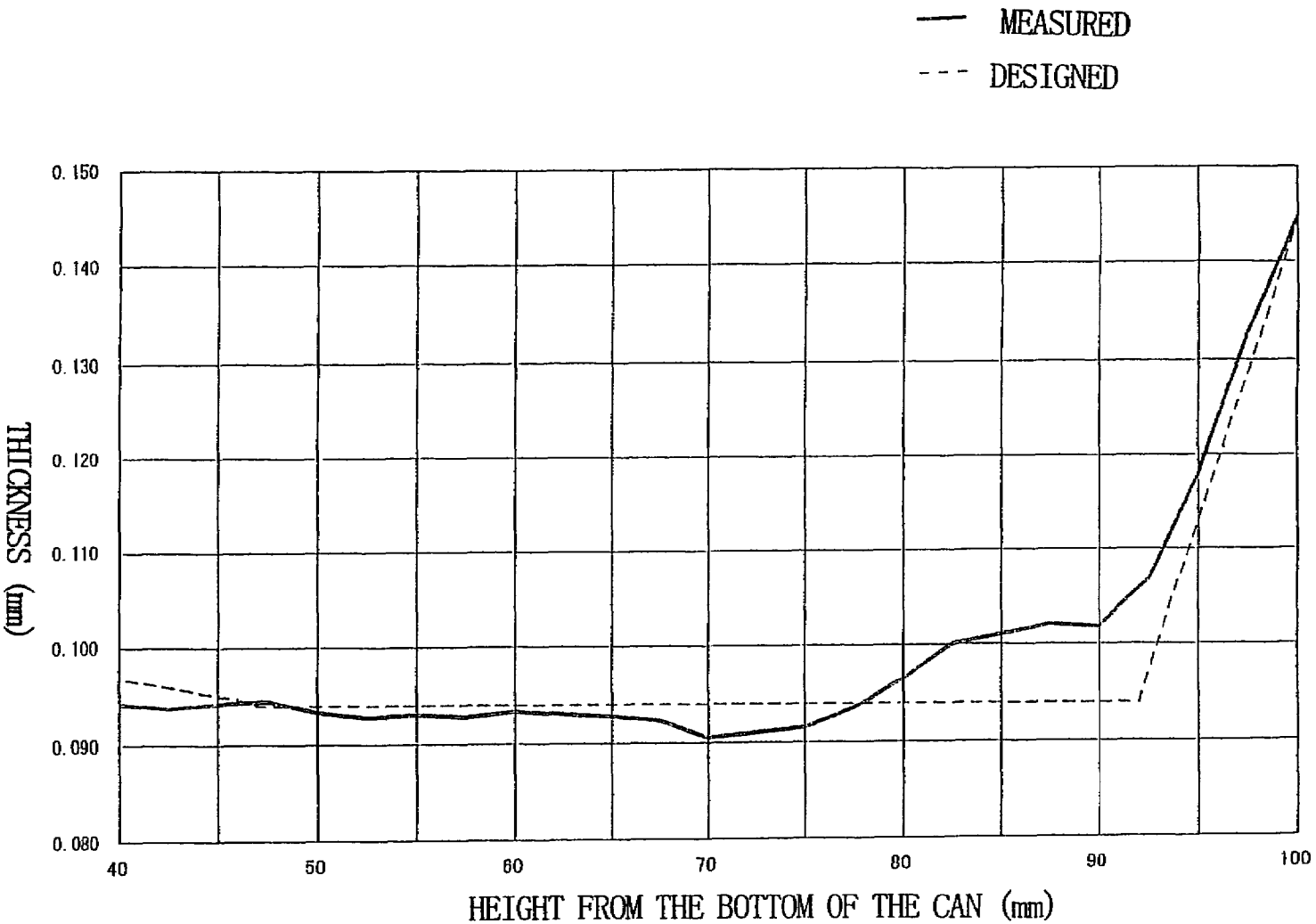
FIG. 5 is a graph in which the designed thickness of the can wall formed by using the conventional punch and the thickness profile of the can wall really formed are corresponded to the height from the bottom of the can.
Figure 6:
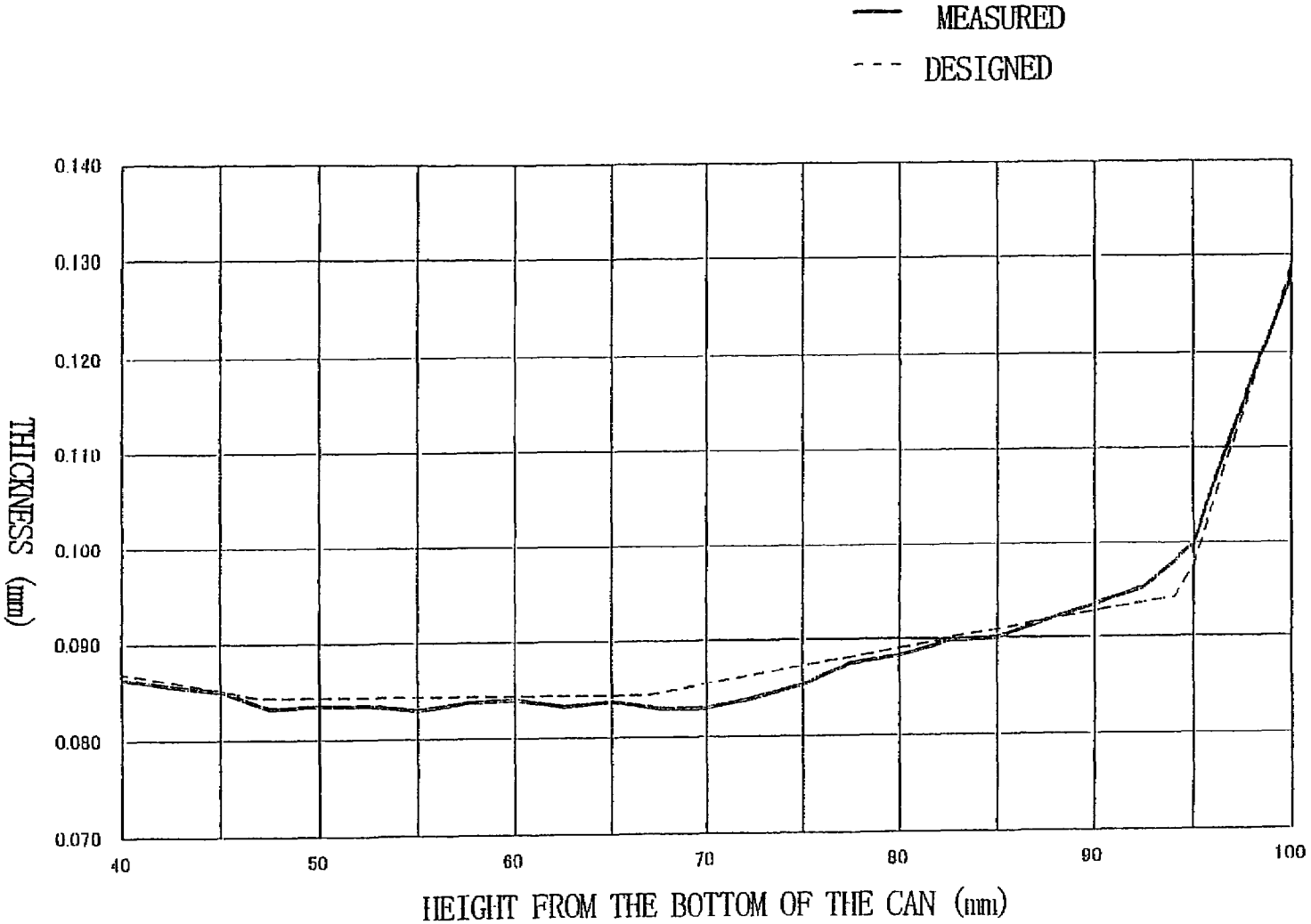
FIG. 6 is a graph in which the designed thickness of the can wall formed by using the punch of the present invention and the thickness profile of the can wall really formed are corresponded to the height from the bottom of the can.

FIG. 3 is a graph in which the designed thicknesses of the can walls of the punches that were used in Examples 1 and 2 and Comparative Examples 1 and 2 are corresponded to the heights from the bottoms of the cans, FIG. 4 is a graph in which the designed thicknesses of the can walls of the draw-ironed cans obtained in Example 1 and Comparative Example 1 are corresponded to the heights from the bottoms of the cans, FIG. 5 is a graph in which the designed thickness of the can wall of Comparative Example 1 and the thickness profile of the can wall really formed are corresponded to the heights from the bottoms of the cans, and FIG. 6 is a graph in which the designed thickness of the can wall of Example 1 and the thickness profile of the can wall really formed are corresponded to the heights from the bottoms of the cans.

TABLE 1

| | Example 1 | Example 2 | Example 3 | Example 4 | Comp. Ex. 1 | Comp. Ex. 2 | Comp. Ex. 3 |
|---|---|---|---|---|---|---|---|
| | $L_1$ = 19 mm | | $L_1$ = 10 mm | | $L_1$ = 19 mm | | $L_1$ = 10 mm |
| $CL_2$ (mm) | $L_2$ = 28 mm θ = 0° 1'14" | $L_2$ = 35 mm θ = 0° 0'59" | $L_2$ = 28 mm θ = 0° 1'14" | $L_2$= 14 mm θ = 0° 2'27" | $L_2$ = 0 mm — | $L_2$ = 14 mm θ = 0° 2'27" | $L_2$ = 0 mm — |
| 0.090 | ○ (Tw = 0.102 mm) | ○ (Tw = 0.104 mm) | ○ (Tw = 0.104 mm) | ○ (Tw = 0.102 mm) | ○ (Tw = 0.097 mm) | ○ (Tw = 0.099 mm) | ○ (Tw = 0.099 mm) |
| 0.085 | ○ (Tw = 0.097 mm) | ○ (Tw = 0.098 mm) | ○ (Tw = 0.098 mm) | ○ (Tw = 0.097 mm) | ○ (Tw = 0.094 mm) | ○ (Tw = 0.095 mm) | ○ (Tw = 0.096 mm) |

TABLE 1-continued

| | Example 1 | Example 2 | Example 3 | Example 4 | Comp. Ex. 1 | Comp. Ex. 2 | Comp. Ex. 3 |
|---|---|---|---|---|---|---|---|
| | $L_1$ = 19 mm | | $L_1$ = 10 mm | | $L_1$ = 19 mm | | $L_1$ = 10 mm |
| $CL_2$ (mm) | $L_2$ = 28 mm θ = 0° 1'14" | $L_2$ = 35 mm θ = 0° 0'59" | $L_2$ = 28 mm θ = 0° 1'14" | $L_2$= 14 mm θ = 0° 2'27" | $L_2$ = 0 mm — | $L_2$ = 14 mm θ = 0° 2'27" | $L_2$ = 0 mm — |
| 0.080 | ○ (Tw = 0.092 mm) | ○ (Tw = 0.094 mm) | ○ (Tw = 0.089 mm) | ○ (Tw = 0.092 mm) | x | x | x |
| 0.075 | ○ (Tw = 0.086 mm) | ○ (Tw = 0.088 mm) | ○ (Tw = 0.085 mm) | ○ (Tw = 0.086 mm) | | | |
| 0.071 | ○ (Tw = 0.082 mm) | ○ (Tw = 0.084 mm) | ○ (Tw = 0.078 mm) | x | | | |
| 0.067 | ○ (Tw = 0.076 mm) | ○ (Tw = 0.078 mm) | x | | | | |

INDUSTRIAL APPLICABILITY

According to the method of drawing and ironing the resin film laminated metal sheet of the present invention, the can wall is effectively prevented from being broken by the occurrence of a shock line that stems from a decrease in the thickness of the can wall, the thickness is decreased nearly as designed, and a can body is effectively formed having a can wall of a further decreased thickness.

Besides, the can body of the invention obtained by the method of the invention has a uniform thickness profile of the can wall, has a decreased weight, and is advantageous from the standpoint of preserving environment and decreasing the cost.

The invention claimed is:

1. A method of drawing and ironing a resin film laminated metal sheet for forming a can body having a bottom portion, a can wall portion and a flange-forming portion by drawing the resin film laminated metal sheet obtained by laminating at least one surface of a metal sheet with an organic resin film, followed by ironing by using a punch, having a front end oriented toward the bottom of the can and a rear end, and a plurality of ironing dies neighboring each other, wherein the punch has no taper at a position corresponding to the flange-forming portion and has a taper formed at a position corresponding to the can wall portion that is continuous to the flange-forming portion, said taper comprises a two-stage taper including a first taper having a first taper angle and a second taper continuing to the rear end portion of the first taper and having a second taper angle different from that of the first taper angle, the first taper having a length greater than a distance between the land of a first ironing die and the land of a final ironing die of the plurality of ironing dies, and the diameter of the taper increasing toward the bottom of the can.

2. A method of drawing and ironing according to claim 1, wherein said punch has a small-diameter portion at a rear end portion thereof, and effects the ironing in a manner that the ratio of ironing is 0 to 15% at the open end of the can body that is formed.

3. A method of drawing and ironing according to claim 2, wherein said plurality of dies are arranged as neighboring dies in succession.

4. A method of draw-ironing according to claim 2, wherein the ratio of ironing is 0 to 10% at the open end of the can body that is formed.

5. A method of drawing and ironing according to claim 1, wherein said plurality of dies are arranged as neighboring dies in succession.

6. A drawn and ironed can made by the method as claimed in claim 1, said drawn and ironed can having a bottom portion, a can wall portion and a flange-forming portion formed by drawing and ironing a resin-coated metal sheet obtained by laminating at least one surface of a metal sheet with an organic resin film, wherein the inner surface of the can wall portion continuous to the flange-forming portion is tapered in a manner that the thickness decreases from the upper side toward the lower side starting from the lower portion of the flange-forming portion, and no step is formed on the outer surface of the can wall portion.

7. A method of draw-ironing according to claim 1, wherein said taper comprises a two-stage taper including a first taper having a first taper angle and a second taper continuing to the rear end portion of the first taper and having a second taper angle different from that of the first taper angle.

8. A method of draw-ironing according to claim 7, wherein the first taper has a length that is greater than the distance between the land of the first ironing die and the land of the final ironing die by 1 to 30 mm.

9. A method of draw-ironing according to claim 7, wherein the second taper angle is greater than the first taper angle.

10. A method of draw-ironing according to claim 1, wherein the distance between the land of the first ironing die and the land of the final ironing die is from 3 to 40 mm.

11. A method of draw-ironing according to claim 1, wherein the distance between the land of the first ironing die and the land of the final ironing die is from 3 to 20 mm.

* * * * *